US012515109B2

(12) United States Patent
Inaba et al.

(10) Patent No.: US 12,515,109 B2
(45) Date of Patent: Jan. 6, 2026

(54) BALL COLLECTING SYSTEM

(71) Applicant: YAMABIKO CORPORATION, Ohme (JP)

(72) Inventors: Eiki Inaba, Ohme (JP); Kenji Nakano, Ohme (JP)

(73) Assignee: Yamabiko Corporation, Tokyo (JP)

( * ) Notice: Subject to any disclaimer, the term of this patent is extended or adjusted under 35 U.S.C. 154(b) by 358 days.

(21) Appl. No.: 18/033,515

(22) PCT Filed: Nov. 27, 2020

(86) PCT No.: PCT/JP2020/044363
§ 371 (c)(1),
(2) Date: Apr. 24, 2023

(87) PCT Pub. No.: WO2022/113303
PCT Pub. Date: Jun. 2, 2022

(65) Prior Publication Data
US 2023/0381600 A1 Nov. 30, 2023

(51) Int. Cl.
*A63B 47/02* (2006.01)

(52) U.S. Cl.
CPC ..... *A63B 47/021* (2013.01); *A63B 2047/022* (2013.01)

(58) Field of Classification Search
CPC .... A63B 47/002; A63B 47/022; A63B 47/021
See application file for complete search history.

(56) References Cited

U.S. PATENT DOCUMENTS

| | | | | |
|---|---|---|---|---|
| 4,750,744 | A | 6/1988 | Michalec | |
| 5,332,350 | A * | 7/1994 | Hollrock | A63B 47/04 414/376 |
| 5,439,224 | A | 8/1995 | Bertoncino | |
| 2001/0002370 | A1 * | 5/2001 | Helstrom | A63B 69/3694 473/168 |
| 2005/0204717 | A1 * | 9/2005 | Colens | G05D 1/648 56/344 |
| 2020/0330833 | A1 | 10/2020 | Nakano et al. | |

FOREIGN PATENT DOCUMENTS

| | | | | |
|---|---|---|---|---|
| JP | 48-86631 | A | 11/1973 | |
| JP | 3-45276 | A | 2/1991 | |
| JP | 3039280 | U * | 7/1997 | |
| JP | 2020-174955 | A | 10/2020 | |
| KR | 20190029084 | A * | 3/2019 | A63B 47/02 |
| WO | 9325286 | A1 | 12/1993 | |
| WO | WO-2022113303 | A1 * | 6/2022 | A63B 47/021 |

* cited by examiner

*Primary Examiner* — Kaitlin S Joerger
(74) *Attorney, Agent, or Firm* — BakerHostetler

(57) ABSTRACT

A ball collecting system includes a picker, and a pit configured to enable balls discharged from the picker to be collected in a ball-collecting space. At least one basket whose upper part is open is disposed in the ball-collecting space to allow the discharged balls to be dropped and stored in the basket. The ball-collecting space is configured such that one end thereof in a horizontal direction is formed as an open zone, to allow the basket to be taken out from the ball-collecting space through the open zone.

6 Claims, 7 Drawing Sheets

BALL COLLECTING SYSTEM

CROSS-REFERENCE TO RELATED APPLICATION

This application is a National Stage of International patent application PCT/JP2020/044363, filed on Nov. 27, 2020, the disclosures of which is incorporated by reference in its entirety.

BACKGROUND OF THE INVENTION

Technical Field

The present invention relates to a ball collecting system for collecting balls on a floor.

Background Art

There has been known a system for use in a driving range or the like to collect a large number of balls scattered over a floor so as to reuse them. For example, the below-mentioned Patent Document 1 discloses a system comprising a picker and a pit. In this system, the picker picks up balls while moving on the floor, and stores the balls in a housing of the picker.

Then, the picker moves to the pit, and on a platform of the pit, discharges the balls from the inside of the housing. The balls discharged from the picker are collected in a container disposed beneath the platform. A worker takes out the balls from the container, and transfers the balls to a location where users are using balls.

CITATION LIST

[Patent Document]

Patent Document 1: US 2005/0204717 A1

SUMMARY OF INVENTION

Technical Problem

In the system described in the Patent Document 1, the worker needs to lift up the balls to take out the balls from the container which is a concave member. Thus, when trying to take out a large number of balls at the same time, workload will significantly increase due to their weight. As just described, in the conventional system, there remains a need for improvement in terms of the workload when taking out balls from the pit.

The present invention has been made to solve the above technical problem, and an object thereof is to provide a ball collecting system capable of reducing workload when taking out balls from a pit.

Solution to Technical Problem

In order to achieve the above object, the present invention provides a ball collecting system for collecting balls on a floor. The ball collecting system comprises: a picker configured to pick up the balls while moving on the floor; and a pit having a ball-collecting space, a top surface located above the ball-collecting space, and an ascending sloping surface on which the picker ascends so as to move from the floor to the top surface, the pit being configured to enable the balls discharged from the picker on the top surface to be collected in the ball-correcting space, wherein at least one basket whose upper part is open is disposed in the ball-collecting space to allow the discharged balls to be dropped and stored in the basket, and wherein the ball-collecting space is configured such that one end thereof in a horizontal direction is formed as an open zone, to allow the basket to be taken out from the ball-collecting space through the open zone.

In the ball collecting system of the present invention having the above feature, a worker can move the basket which stores the balls therein, thereby taking out the balls from the ball-collecting space while leaving the balls in the basket. This makes it possible to reduce workload as compared to another working mode in which the worker takes out the balls from a pit without using any basket.

It should be noted that as used in this specification, the term "floor" means a surface over which balls are scattered, and not limited to an in-door surface. Therefore, the ball collecting system of the present invention may be used for collection of balls scattered over an in-door floor surface, or may be used for collection of balls scattered over an out-door ground surface.

Preferably, in the ball collecting system of the present invention, the pit has a descending sloping surface on which the picker descends so as to move from the top surface to the floor, wherein the ascending sloping surface, the top surface and the descending sloping surface are arranged along a first direction in top plan view, and the open zone is formed at one end of the ball-collecting space in a second direction intersecting the first direction, in top plan view.

According to this feature, it becomes possible to cause the picker to ascend the ascending sloping surface and descend the descending sloping surface by moving the picker along the first direction. Further, it is possible to take out the balls from the ball-collecting space while leaving the balls in the basket, by moving the basket in the second direction. That is, according to the above feature, it becomes possible to ensure a moving path of the picker, and a take-out path of the basket.

Preferably, in the ball collecting system of the present invention, the pit comprises: a plate-shaped member defining the top surface; and a support supporting the plate-shaped member from therebelow, the support comprising a plurality of pillar members each extending in a vertical direction, wherein the ball-collecting space and the open zone are formed among the plurality of pillar members.

According to this feature, it becomes possible to define the top surface, the ball-collecting space and the open zone, while configuring the pit using a simple configuration comprising the plate-shaped member and the support.

Preferably, in the ball collecting system of the present invention, the basket is disposed plurally in the ball-collecting space.

According to this feature, an operation of taking out the baskets from the ball-collecting space can be performed while the operation is divided into plural steps. That is, it becomes possible to perform an operation of taking out baskets which are increased in weight by storing a large number of balls therein, without using a large force. The plural baskets taken out from the ball-collecting space may be transferred at once, using a trolley, a truck or the like.

More preferably, the above ball collecting system, the pit comprises a distribution structure configured to guide and distribute the balls discharged from the picker to the plural baskets.

According to the ball collecting system having this feature, it is possible to prevent the balls from being stored disproportionately in a part of the baskets. This makes it possible to equalize the respective weights of the baskets each storing the balls therein, thereby performing the operation of taking out these baskets, without using a large force.

More preferably, in the above ball collecting system, at least one of the top surface and the distribution structure is provided with an inclined surface which is inclined with respect to a horizontal plane to cause the balls discharged from the picker to be rollingly moved.

According to this feature, even if the picker does not strictly set a position at which the balls are discharged, the inclined surface can give directionality to the discharged balls, thereby guiding the balls.

Preferably, in the ball collecting system of the present invention, the top surface is configured to cover at least part of the ball-collecting space in top plan view.

According to this feature, the picker configured to discharge the balls therefrom can be disposed on the top surface in close relation to the ball-collecting space. This makes it possible to reliably collect the balls discharged from the picker in the ball-collecting space.

Preferably, in the ball collecting system of the present invention, the picker has a picker inclined surface configured to cause the balls to be rollingly moved and directed toward the ball-collecting space.

According to this feature, it becomes possible to reliably collect the balls discharged from the picker in the ball-collecting space, with a simple configuration.

Effect of Invention

The present invention makes it possible to provide a ball collecting system capable of reducing workload when taking out the balls from the pit.

DESCRIPTION OF EMBODIMENTS

Figure 1:
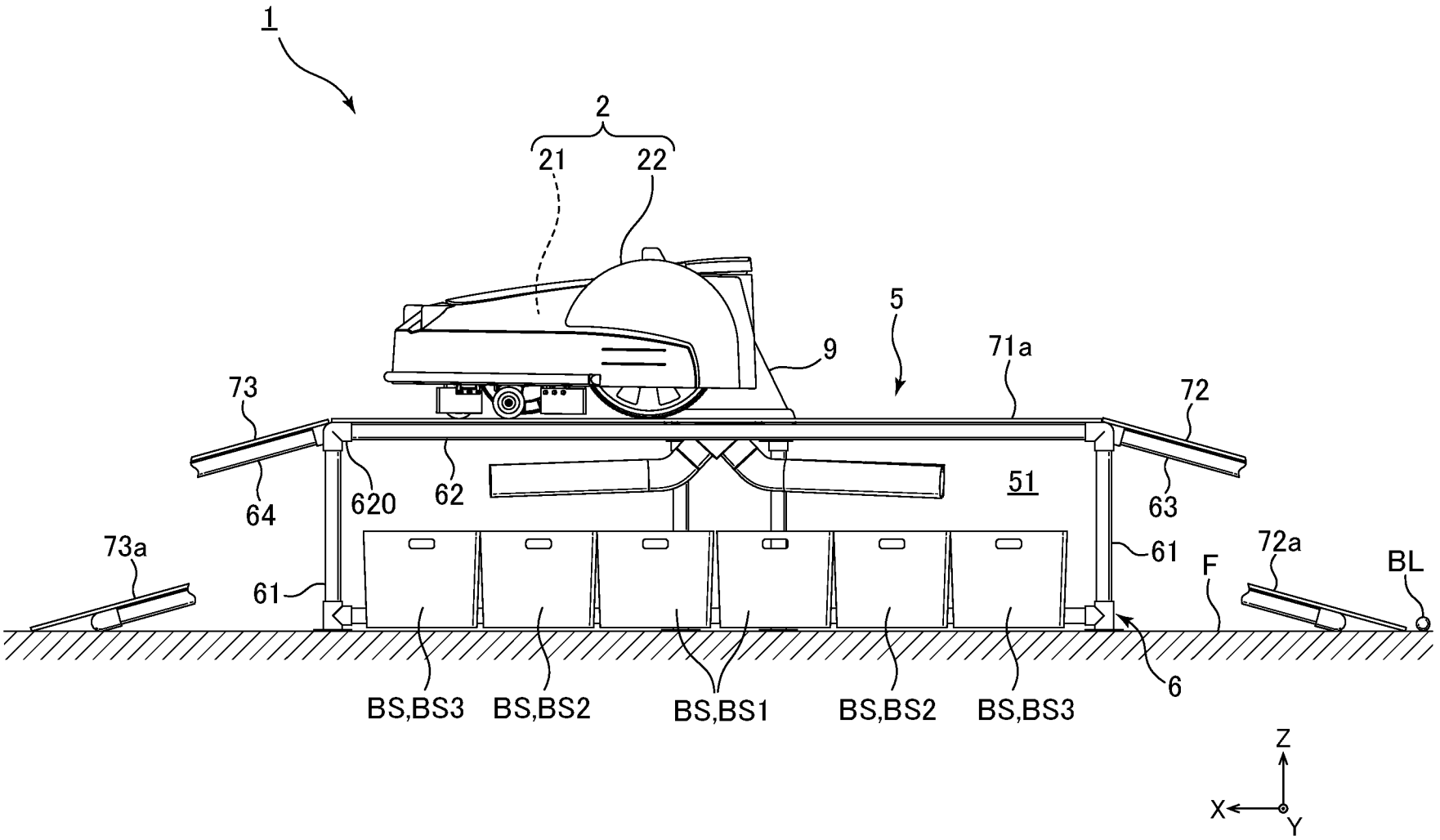
FIG. 1 is a side view of a ball collecting system according a first embodiment of the present invention.

FIG. 1 is a side view of a ball collecting system 1 according a first embodiment of the present invention (hereinafter referred to as "system 1"). This system 1 is applied to a driving range in which players shoot balls BL, and configured to collect a large number of balls BL scattered over a floor F of the driving range. The system 1 comprises a picker 2 and a pit 5.

For facilitating understanding of explanation, the following description will be made, using orthogonal coordinates in which a horizontal direction along which the below-mentioned ascending sloping surface 72*a*, top surface 71*a* and descending sloping surface 73*a* are arranged in top plan view and a vertical-up direction are defined, respectively, as an X-direction and a Z-direction, and a direction orthogonal to the X-direction and the Z-direction is defined as a Y-direction. The X-direction is one example of "first direction" set forth in the appended claims, and the Y-direction is one example of "second direction" set forth in the appended claims. In FIGS. 3 to 7, the same coordinates are shown.

<Picker>

Figure 2:
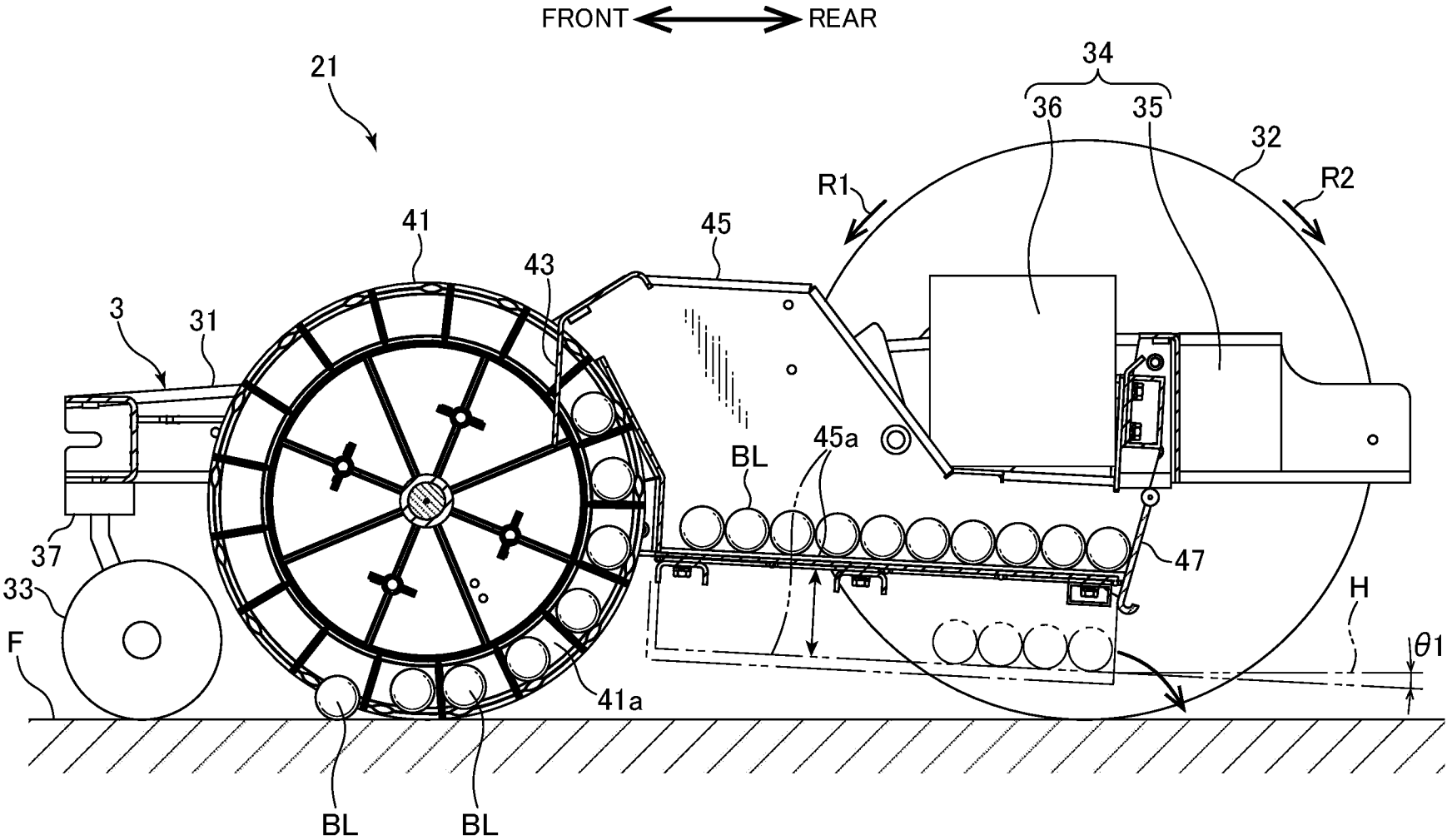
FIG. 2 is a sectional view of a picker body of a picker in FIG. 1.

With reference to FIGS. 1 and 2, the configuration of the picker 2 will be described. FIG. 2 is a sectional view of the below-mentioned picker body of the picker 2. As shown in FIG. 1, the picker 2 comprises a picker body 21, and a cover 22 covering the picker body 21. FIG. 2 schematically shows the picker 2 in a state in which it is vertically cut along a center line thereof. The picker body 21 comprises a moving body 3, a pickup wheel 41, a releasing member 43, and a tank 45.

The moving body 3 comprises a frame 31, a pair of rear wheels 32, and a pair of front wheels 33. The rear wheels 32 are provided at a rear end of the frame 31, and configured to be driven by a drive unit 34. On the other hand, the front wheels 33 are provided at a front end of the frame 31, and configured such that the orientation thereof is adjusted by an adjustment unit 37. The drive unit 34 comprises a battery 35 serving as a power supply, and a motor 36. In the following description, a direction along which the moving body 3 moves when both the rear wheels 32 are rotated in a direction indicated by the arrow R1 will be referred to as "front (forward)", and a direction along which the moving body 3 moves when both the rear wheels 32 are rotated in a direction indicated by the arrow R2 will be referred to as "rear (rearward)".

The pickup wheel 41 is disposed between the pair of rear wheels 32 and the pair of the front wheels 33. The pickup wheel 41 is an assembly of a large number of circular discs. The large number of circular discs have identical configurations, and arranged such that they are aligned at even intervals in a depth direction of the drawing sheet of FIG. 2. A plurality of pockets 41*a* are formed between adjacent two of the circular discs. The plurality of pockets 41*a* are arranged side-by-side along a circumferential direction of the circular discs.

The releasing member 43 is fixed to the frame 31. As discussed detail later, the releasing member 43 is configured to forcibly release a ball BL from each pocket 41*a* of the pickup wheel 41.

The tank 45 is fixed to the frame 31 at a position rearward of the releasing member 43. The tank 45 internally forms a space for receiving balls BL picked up by the picker 2, and a bottom surface 45*a* of the tank 45 is inclined. More specifically, when the floor F on which the picker 2 is placed is a horizontal plane, the bottom surface 45*a* is inclined downwardly with respect to the horizontal plane H by an angle θ1. The bottom surface 45*a* is one example of "picker inclined surface" set forth in the appended claims. A rear end of the space inside the tank 45 is defined by a back plate 47.

<Pit>

Figure 3:
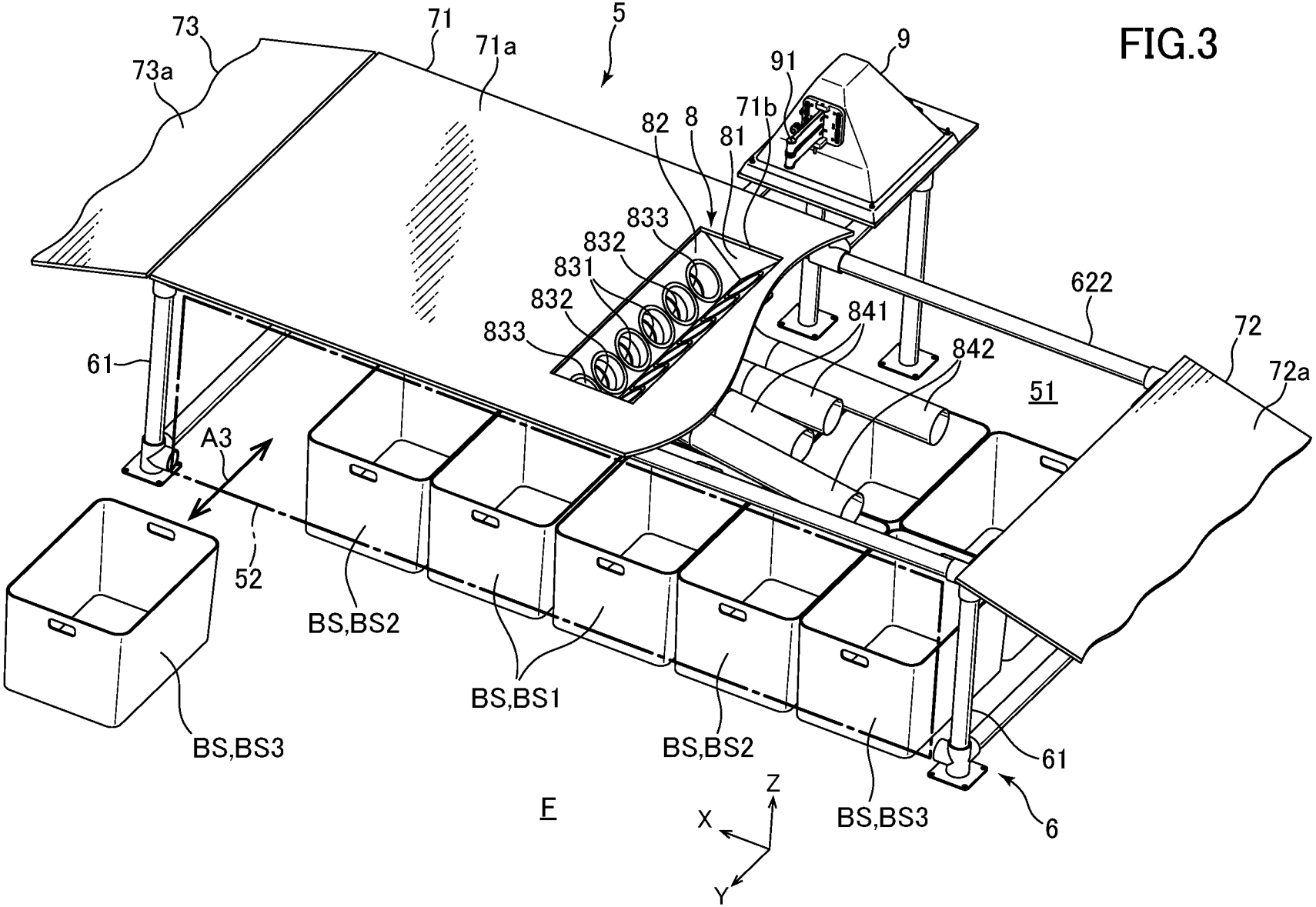
FIG. 3 is a perspective view of a pit in FIG. 1.
Figure 4:
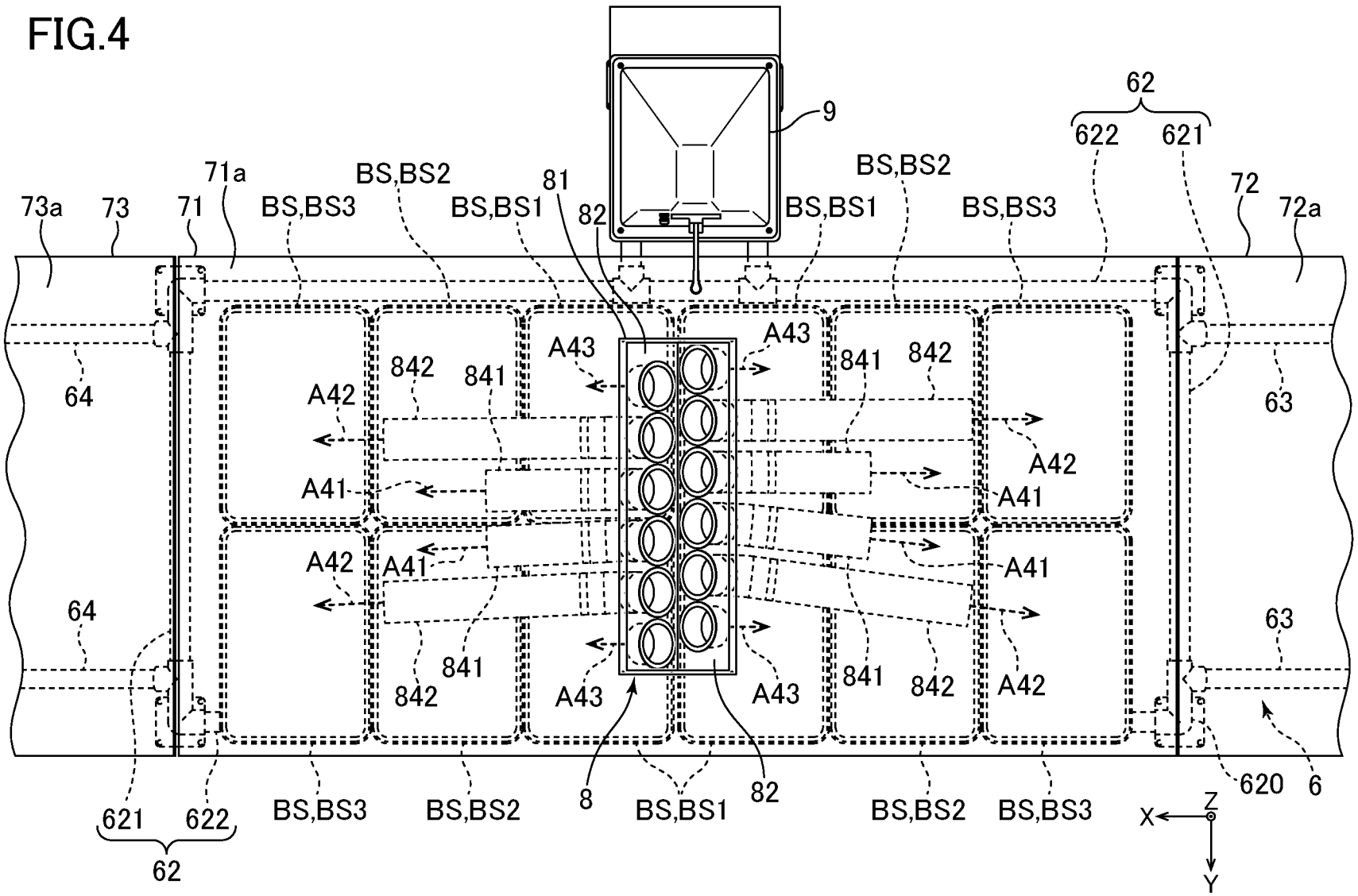
FIG. 4 is a top plan view of the pit in FIG. 1.

Next, the configuration of the pit 5 will be described with reference to FIGS. 1, 3 and 4. FIG. 3 is a perspective view of the pit 5, and FIG. 4 is a top plan view of the pit 5. The pit 5 is disposed on one block of the floor F or disposed adjacent to the floor F, and comprises a support 6, a top plate 72, two sloping plates 72, 73, a distribution structure 8, and a battery charger 9. For facilitating understanding of explanation, in FIG. 3, illustration of a part of the top plate 71 is omitted, and in FIG. 4, a part of the configuration located beneath the top plate 71 is indicated by broken lines.

The support 6 comprises four pillar members 61 and four beam members 62. The support 6 further comprises a pair of sloping pillar members 63 and a pair of sloping pillar members 64. Each of the pillar members 61, the beam members 62 and the sloping pillar members 63, 64 is a linearly-extending cylindrical-shaped member formed of a metal material.

As shown in FIGS. 1 and 3, the four pillar members 61 are arranged to extend vertically on the floor F, in mutually spaced-apart relation in a horizontal direction.

The beam members 62 comprise a pair of first beam members 621, and a pair of second beam members 622 each having a length greater than that of each of the first beam members 621. Each of the first beam members 621 and the second beam members 622 is disposed to extend approximately horizontally between corresponding two of the pillar members 61, and opposite ends of each of the first and second beam members 621, 622 are connected, respectively, to upper ends of the corresponding two of the pillar members 61 through two joints 620. As shown in FIG. 4, the pair of first beam members 621 are arranged to be opposed to each other in the X-direction, and the pair of second beam members 622 are arranged to be opposed to each other in the Y-direction. As a result of arranging the first beam members 621 and the second beam members 622 in this manner, the beam members 62 exhibit an approximately rectangular shape in top plan view, as a whole.

As shown in FIGS. 1 and 4, the sloping pillar members 63 are disposed on a negative X-directional side of the beam members 62, and the sloping pillar members 64 are disposed a positive X-directional side of the beam members 62. Each of the sloping pillar members 63, 64 is connected to a corresponding one of the first beam members 621 at its upper end, and placed on the floor F at its lower end, so that it is disposed to inclinedly extend between the corresponding first beam member 621 and the floor F.

The top plate 71 is one example of "plate-shaped member" set forth in the appended claims, and has a thin plate shape. The top plate 71 is formed of a material which exhibits a given rigidity to allow the picker 2 to be placed on the top surface 71*a* thereof. As shown in FIGS. 3 and 4, a rectangular opening 71*b* is opened in a central region of the top surface 71*a*. The opening 71*b* penetrates through the top plate 71 in a thickness direction thereof. The top plate 71 is supported from therebelow by the support 6, such that a void space is formed between the top plate 71 and the floor F, and the top surface 71*a* is disposed approximately horizontally.

As shown in FIGS. 1 and 3, a ball-collecting space 51 is formed beneath the top plate 71. The ball-collecting space 51 is an approximately rectangular parallelepiped-shaped space roughly defined by the floor F, the beam members 62 and the four pillar members 61. The top surface 72*a* covers the entire ball-collecting space 51 in top plan view. As shown in FIG. 3, the ball-collecting space 51 has a Y-directional end formed as an open zone 52.

Each of the sloping plates 72, 73 has a thin plate shape. The sloping plate 72 is supported from therebelow by the pair of sloping pillar members 63, and the sloping plate 73 is supported from therebelow by the pair of sloping pillar members 64. In this manner, the sloping plate 72 defines an ascending sloping surface 72*a* inclinedly extending between the floor F and a negative X-directional end of the top surface 71*a*, and the sloping plate 73 defines a descending sloping surface 73*a* inclinedly extending between a positive X-directional end of the top surface 71*a* and the floor F.

As shown in FIGS. 3 and 4, the distribution structure 8 comprises a groove member 81, four first pipe members 841, and four second pipe members 842.

The groove member 81 has two inner surfaces 82 each inclined with respect to a horizontal plane. The two inner surfaces 82 define therebetween a groove whose width gradually decreases in a direction from upper ends to lower ends of the inner surfaces 82. The inner surfaces 82 are one example of "inclined surface" set forth in the appended claims. Each of the inner surfaces 82 is formed with three pairs of circular through-holes 831, 832, 833 each having approximately the same diameter. The pair of through-holes 831 are formed in a central region of the inner surface 82, and the pair of through-holes 832 are formed, respectively, on a positive Y-directional side and a negative Y-directional side of the pair of through-holes 831. The pair of through-holes 833 are formed, respectively, on the positive Y-directional side and the negative Y-directional side of the pair of through-holes 832. The groove member 81 is fixed to the top plate 71 such that the groove thereof is located beneath the opening 71*b* of the top plate 71.

Each of the first pipe members 841 and the second pipe members 842 has a diameter approximately equal to the diameter of each of the through-holes 831, 832, 833. Each of the second pipe members 842 has a length greater than that of each of the first pipe members 841. One ends of the four first pipe members 841 are connected, respectively, to the two pairs of through-holes 831, and one ends of the four second pipe members 842 are connected, respectively, to the two pairs of through-holes 832. Each of the first pipe members 841 and the second pipe members 842 is disposed to extend approximately along the X-direction toward an open end thereof.

The battery charger 9 is disposed on the lateral side of the top plate 71. The battery charger 9 comprises an electrode 91 protruding toward the top plate 71.

<Collection of Balls>

Figure 5:
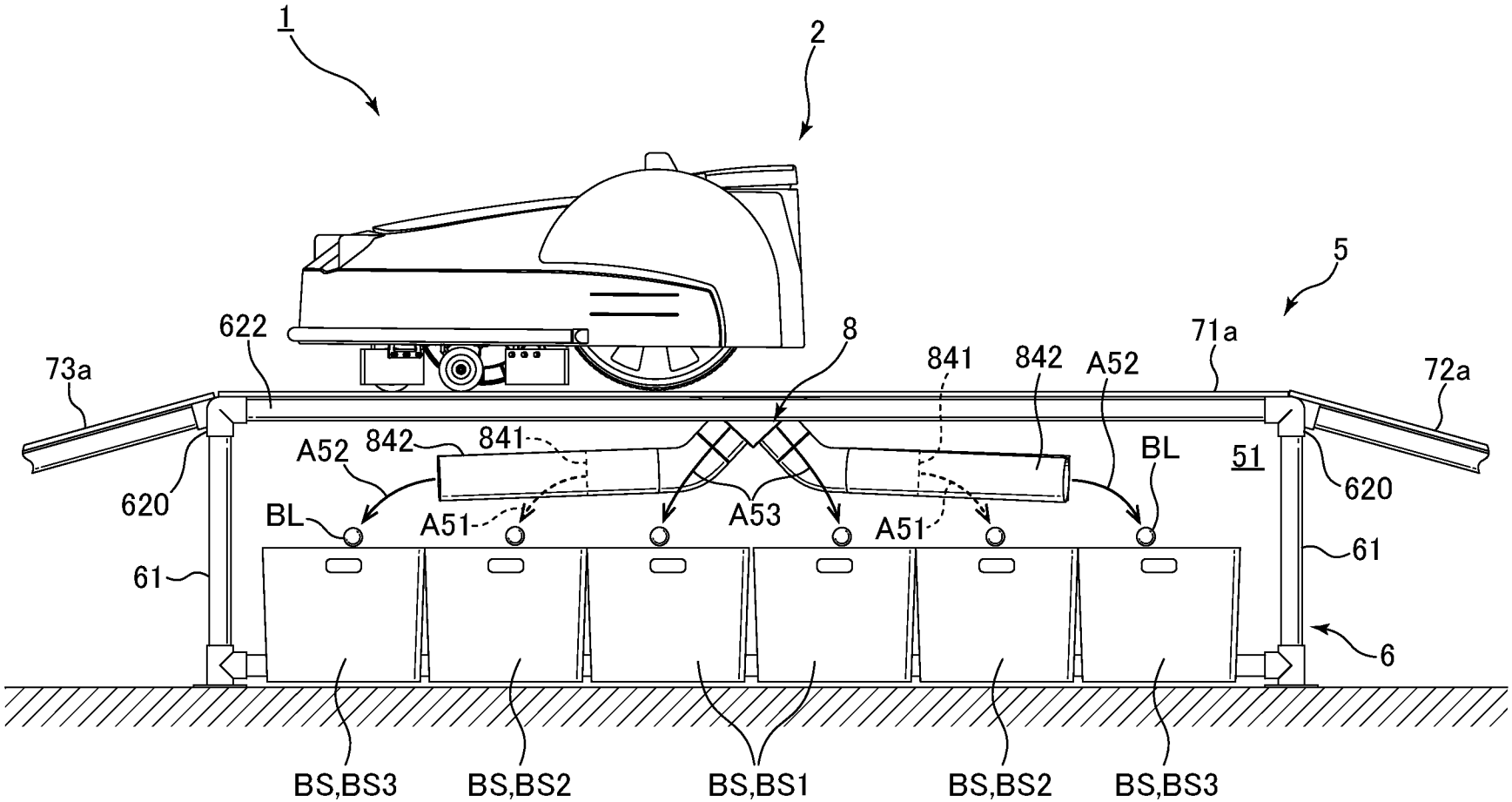
FIG. 5 is a side view of the ball collecting system in FIG. 1.

Next, collection of balls BL by the system 1 will be described with reference to FIGS. 1 to 5. FIG. 5 is a side view of the system 1, wherein the vicinity of the top surface 71*a* is enlargedly illustrated.

As shown in FIG. 4, twelve (six in the X-direction and two lines in the Y-direction) baskets BS are arranged in the ball-collecting space 51 of the pit 5. Each of the baskets BS is a general-purpose box formed of a hard resin, and an upper part thereof is opened. Specifically, four baskets BS1 are arranged in an X-directional central region of the ball-collecting space 51, and two pairs of baskets BS2 and two pairs of baskets BS3 are sequentially arranged, respectively, on both sides of the brackets BS1 in the X-direction. The four baskets BS1 are arranged adjacent, respectively, to the four through-holes 833. The two pairs of baskets BS2 are arranged adjacent, respectively, to the open ends of the four first pipe members 841, and the two pairs of baskets BS3 are arranged adjacent, respectively, to the open ends of the four second pipe members 842.

When the motor 36 generates a torque in response to receiving a supply of electric power from the battery 45, the rear wheels are rotationally driven, so that the picker 2 moves on the floor F of the driving range. The picker 2 operates according to a given control program, and a moving direction of the picker 2 is changed according to the orientation of the front wheels 33 adjusted by the adjustment unit 37. The picker 2 is automatically controlled in accordance with a given program to move over the entire area where balls BL need to be collected, while acquiring information about its own location by, e.g., receiving positioning signals (e.g., GPS signals) from a satellite of a satellite positioning system.

The pickup wheel 41 of the picker 2 is configured to be rollingly moved on the floor F along with forward movement of the picker 2. According to the forward movement, balls BL on the floor F are caught and held by the pockets 41*a* of the pickup wheel 41, so that the balls BL are picked up from the floor F.

The balls BL held by the pockets 41*a* are carried upwardly along with the rolling movement of the pickup wheel 41 and pressed against the releasing member 43. Thus, the balls BL are pushed by the releasing member 43 and discharged from the pockets 41*a*. In this manner, the balls BL are stored in the tank 45. When the number of balls BL in the tank 45 reaches a given value, or when the amount of electricity stored in the battery falls below a given value, the picker 2 is controlled to move toward the pit 5.

The picker 2 moves forwardly in the X-direction, and ascends the ascending sloping surface 72*a* of the pit 5 to move from the floor F to the top surface 71*a*. The picker 2 is controlled to stop just above the opening 71*b* of the top plate 71, and then the bottom surface 45*a* of the tank 45 is translated downwardly, as indicated by the broken lines in FIG. 2. Thus, a gap is formed between the bottom surface 45*a* and the back plate 47, and the balls BL in the tank 45 are discharged from the gap. Since the bottom surface is inclined as mentioned above, the balls BL in the tank 45 are rollingly moved on the bottom surface 45*a* and directed in the negative X-direction. Therefore, the balls BL discharged from the picker 2 are also directed in the negative X-direction.

The balls BL discharged from the tank 45 of the picker 2 are dropped in the groove member 81 of the distribution structure 8 through the opening 71*b* of the top plate 71. The two inner surfaces 82 of the groove member 81 are inclined with respect to a horizontal plane, as mentioned above. Thus, due to the inclination of the inner surfaces 82, each of the balls BL dropped in the groove member 81 is rollingly moved with directionality, and enters one of the through-holes 831, 832, 833.

For example, the ball BL entered one of the through-holes 831 moves while being guided by a corresponding one of the first pipe members 841, and the ball BL entered one of the through-holes 832 moves while being guided by a corresponding one of the second pipe members 842. These balls BL are discharged, respectively, from the open ends of the corresponding first pipe member 841 and the corresponding second pipe member 842, and dropped, respectively, in a corresponding one of the baskets BS2 and a corresponding one of the baskets BS3, as indicated by the arrowed lines A41, A42 in FIG. 4 or as indicated by the arrowed lines A51, A52 in FIG. 5. The ball BL entered one of the through-holes 833 is dropped in one of the basket BS, as indicated by the arrowed line A43 in FIG. 4 or as indicated by the arrowed line A53 in FIG. 5. That is, the balls BL are distributed to the baskets BS1, BS2, BS3 through the distribution structure 8, and stored in the baskets BS1, BS2, BS3.

Further, when the picker 2 is stopped on the top plate 71*a* of the pit 5, an electrode (not illustrated) provided on the lateral side of the picker 2 is connected to the electrode 91 of the battery charger 9. Thus, electric power is suppled from the battery charger 9 to the battery 35, so that the battery 35 is charged.

When the discharge of the balls BL and the charge of the battery 35 are completed, the picker 2 is controlled to move forwardly in the positive X-direction, and descends the descending sloping surface 73*a* of the pit 5 to move from the top surface 71*a* to the floor F. The picker 2 arrived at the floor F further moves on the floor F to pick up other balls BL.

A worker of the driving range moves the basket BS in the Y-direction as indicated by the arrowed line A3 in FIG. 3 to take out balls BL from the ball-collecting space 51 through the open zone 52, while leaving the balls BL in the basket BS. Then, the worker loads the basket BS on a carrier of a vehicle or the like, and transfers the basket BS to a location where players shoot balls BL, to supply the balls BL in the basket BS so as to allow the players to reuse the balls BL.

Functions/Effects

Next, functions/effects based on the system 1 according to the first embodiment will be described.

According to the system 1 configured as above, a worker can move the basket BS which stores the balls BL therein, in a horizontal direction, thereby taking out the balls BL from the ball-collecting space 51 while leaving the balls BL in the basket BS. This makes it possible to reduce workload as compared to another working mode in which the worker takes out the balls BL from a pit while lifting up the balls BL in a vertical direction. Particularly, in a case where a worker manually lifts up the balls BL, the system 1 can further reduce the workload.

In the first embodiment, the pit 5 has the descending sloping surface 73*a* on which the picker 2 descends so as to move from the top surface 71*a* to the floor F, wherein the ascending sloping surface 72*a*, the top surface 71*a* and the descending sloping surface 73*a* are arranged along the X-direction in top plan view, and the open zone 52 is formed at one end of the ball-collecting space 51 in the Y-direction.

According to the system 1 configured as above, it becomes possible to cause the picker 2 to ascend the ascending sloping surface 72*a* and descend the descending sloping surface 73*a* by moving the picker 2 along the X-direction. That is, it becomes possible to allow the picker 2 to ascend and descend a slope simply by moving the picker 2 along one direction, without requiring the picker 2 to make a large change in direction. Further, it is possible to take out the balls BL from the ball-collecting space 51 while leaving the balls BL in the basket BS, by moving the basket BS in the Y-direction. That is, according to the above configuration, it becomes possible to ensure a moving path of the picker 2, and a take-out path of the basket BS. For example, when there is an obstacle on the descending sloping surface 73*a*, the picker 2 may be controlled to descend the ascending sloping surface 72*a*.

In the first embodiment, the pit 5 comprises: the top plate 71 defining the top surface 72*a*; and the support 6 supporting the top plate 71 from therebelow, and comprising the plurality of pillar members 61 each extending in a vertical direction, wherein the ball-collecting space 51 and the open zone 52 are formed among the plurality of pillar members 61.

According to the system 1 configured as above, it becomes possible to define the top surface 71*a*, the ball-collecting space 51 and the open zone 52, while configuring the pit 5 using a simple configuration comprising the top plate 71 as a plate-shaped member and the support 6.

In the first embodiment, the basket BS is disposed plurally in the ball-collecting space 51.

According to the system 1 configured as above, an operation of taking out the baskets BS from the ball-collecting space 51 can be performed while the operation is divided into plural steps. That is, it becomes possible to perform an operation of taking out baskets BS which are increased in weight by storing a large number of balls BL therein, without using a large force. The plural baskets BS taken out from the ball-collecting space 51 may be transferred at once, using a trolley, a truck or the like.

In the first embodiment, the pit 5 comprises the distribution structure 8 configured to guide and distribute the balls BL discharged from the picker 2 to the plural baskets.

According to the system 1 configured as above, it is possible to prevent the balls BL from being stored disproportionately in a part of the baskets BS. This makes it possible to equalize the respective weights of the baskets BS each storing the balls BL therein, thereby performing the operation of taking out these baskets, without using a large force.

In the first embodiment, the top surface 71*a* is configured to cover at least part of the ball-collecting space 51 in top plan view.

According to the system 1 configured as above, the picker 2 configured to discharge the balls BL therefrom can be disposed on the top surface 71*a* in close relation to the ball-collecting space 51. This makes it possible to reliably collect the balls BL discharged from the picker 2 in the ball-collecting space 51.

Figure 6:
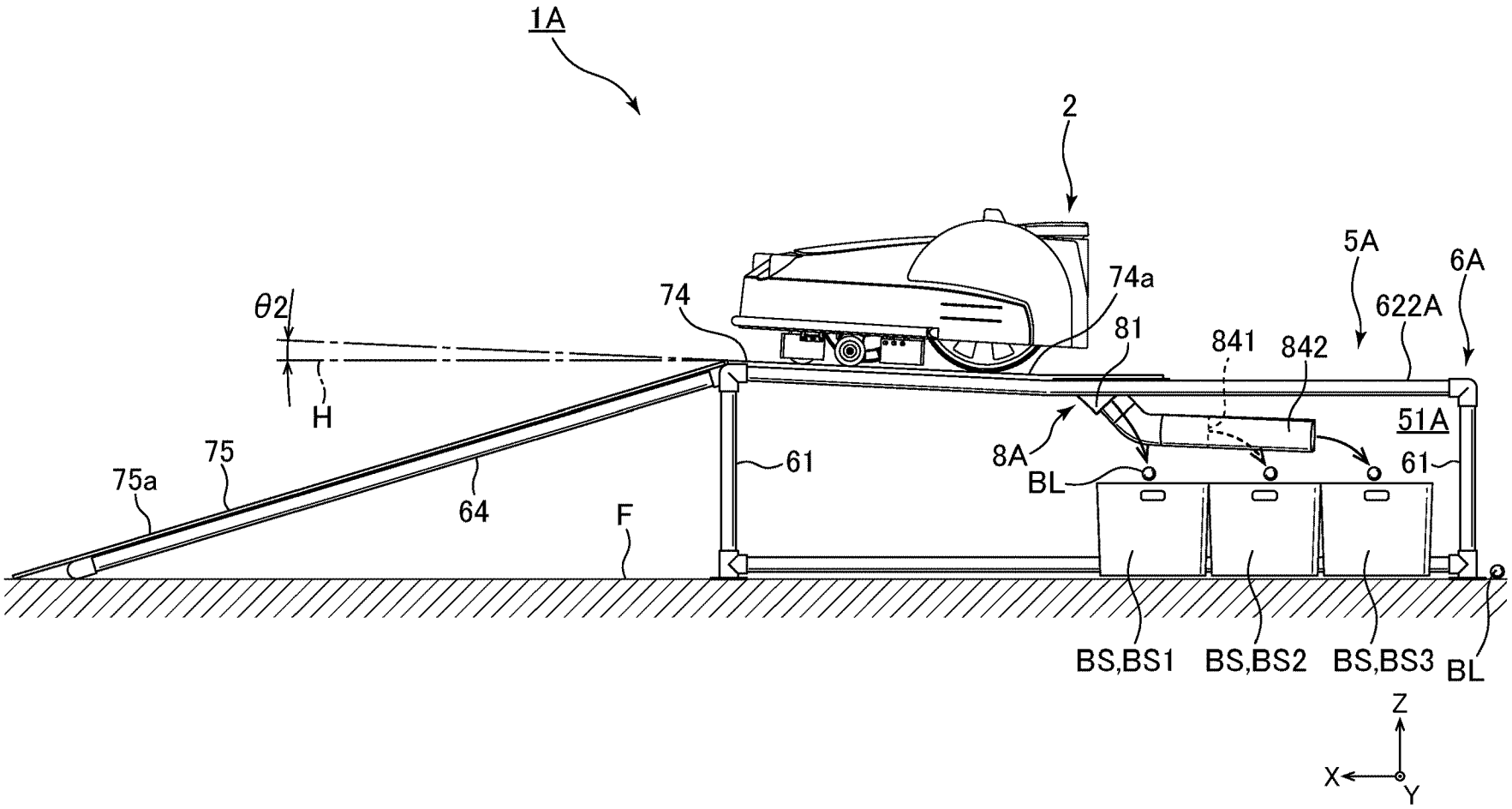
FIG. 6 is a side view of a ball collecting system according to a second embodiment of the present invention.
Figure 7:
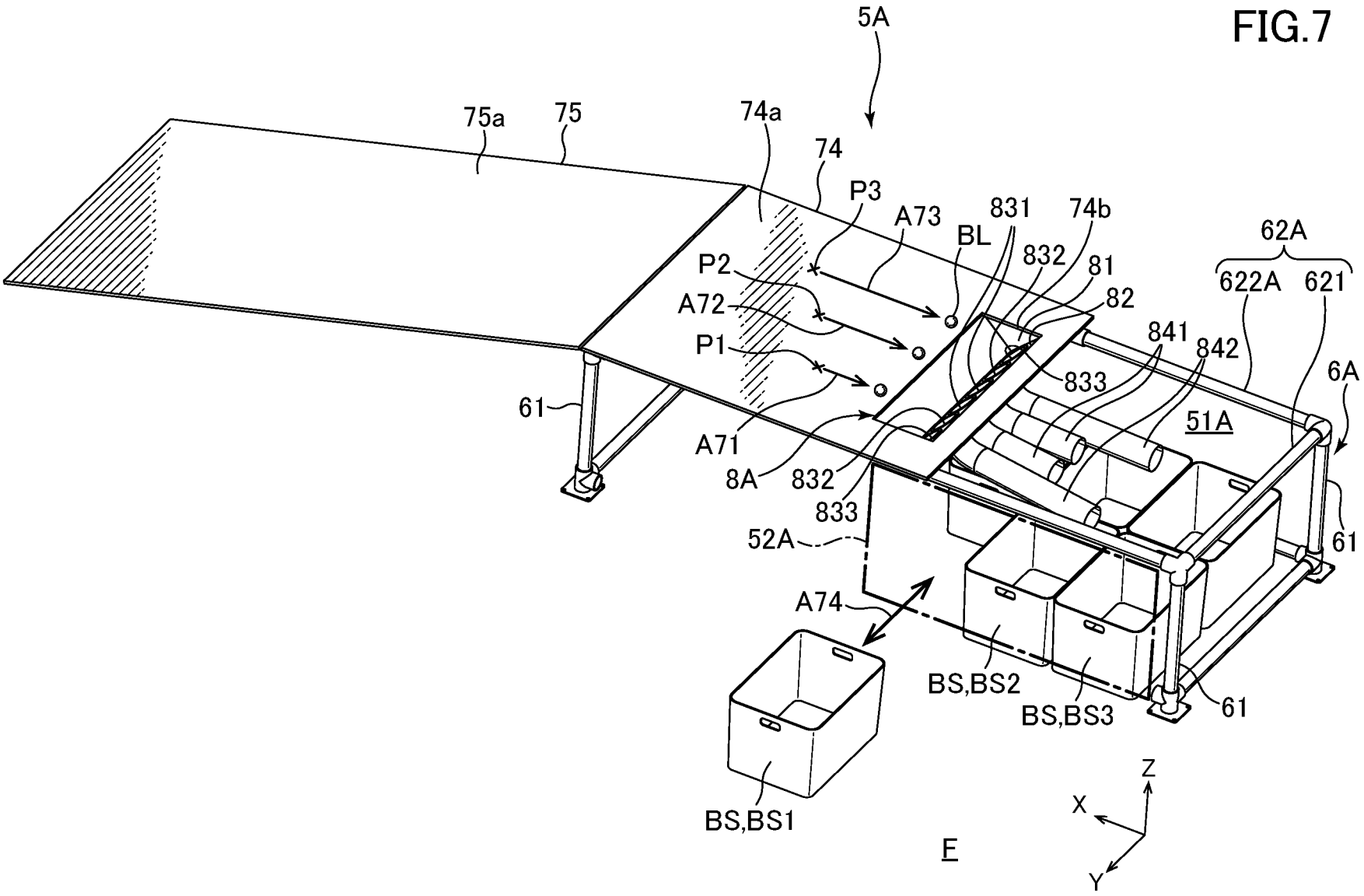
FIG. 7 is perspective view of a pit in FIG. 6.

Next, a ball collecting system 1A according to a second embodiment of the present invention (hereinafter referred to as "system 1A") will be described with reference to FIGS. 6 and 7. FIG. 6 is a side view of the system 1A, and FIG. 7 is perspective view of a pit 5A. In the configuration of the system 1A, the same element or component as that in the configuration of the system 1 will be assigned with the same reference code, and description thereof will be appropriately omitted.

For facilitating understanding of explanation, the following description will be made, using orthogonal coordinates in which a horizontal direction along which the below-mentioned ascending-descending sloping surface 75*a*, and top surface 74*a* are arranged in top plan view and a vertical-up direction are defined, respectively, as an X-direction and a Z-direction, and a direction orthogonal to the X-direction and the Z-direction is defined as a Y-direction. The X-direction is one example of "first direction" set forth in the appended claims, and the Y-direction is one example of "second direction" set forth in the appended claims.

<Pit>

The pit 5A of the system 1A comprises a support 6A, a top plate 74, a sloping plate 75, and a distribution structure 8A.

As shown in FIG. 6, in each of a pair of second beam members 622A of the support 6A, a portion of the second beam member 622A including a positive X-directional end thereof is inclined with respect to a horizontal plane H by an angle θ2. Specifically, the portion of the second beam member 622A is gradually inclined downwardly in a negative X-direction.

The top plate 74 is one example of "plate-shaped member" set forth in the appended claims, and has a thin plate shape. The top plate 74 is formed of a material which exhibits a given rigidity to allow a picker 2 to be placed on a top surface 74*a* thereof. As shown in FIG. 7, a rectangular opening 74*b* is opened in the vicinity of a negative X-directional end of the top surface 74*a*. The opening 74*b* penetrates through the top plate 74 in a thickness direction thereof. The top plate 71 is supported from therebelow by the inclined portions of the second beam members 622A, such that a void space is formed between the top plate 74 and a floor F, and the top surface 74*a* is inclined with respect to the horizontal plane H by the angle θ2. The top surface 74*a* is one example of "inclined surface" set forth in the appended claims.

A ball-collecting space 51A is formed beneath the top plate 74. The ball-collecting space 51 is an approximately rectangular parallelepiped-shaped space roughly defined by the floor F, the second beam members 622A and four pillar members 61. The top surface 74*a* covers a part of the ball-collecting space 51 in top plan view. As shown in FIG. 7, the ball-collecting space 51A has a Y-directional end formed as an open zone 52A.

The sloping plate 75 has a thin plate shape. The sloping plate 75 is supported from therebelow by a pair of sloping pillar members 64. In this manner, the sloping plate 75 defines an ascending-descending sloping surface 75*a* inclinedly extending between a positive X-directional end of the top surface 74*a* and the floor F. The ascending-descending sloping surface 75*a* is one example of "ascending sloping surface" set forth in the appended claims, and is also one example of "descending sloping surface" set forth in the appended claims.

In the distribution structure 8A, three pairs of through-holes 831, 832, 833 are formed only in a negative X-directional-side one of two inner surfaces 82 of a groove member 82. One ends of two first pipe members 841 are connected, respectively, to the pair of through-holes 831, and one ends of two second pipe members 842 are connected, respectively, to the pair of through-holes 832. Each of the first pipe members 841 and the second pipe members 842 is disposed to extend approximately along the X-direction toward an open end thereof <Collection of Balls>

Next, collection of balls BL by the system 1A will be described.

When the number of balls BL in a tank 45 (see FIG. 2) reaches a given value, the picker 2 is controlled to move toward the pit 5A. The picker 2 moves backwardly in the negative X-direction, and ascends the ascending-descending sloping surface 75*a* of the pit 5A to move from the floor F to the top surface 74*a*. The picker 2 is controlled to stop in the vicinity of the opening 74*b* of the top plate 74, and then discharge the balls BL. In this process, even when electricity is stored in a battery 35 in a given amount or more, a charging operation for the battery 35 may be performed.

The balls BL discharged from the tank 45 of the picker 2 are dropped on the top plate 74*a*, rollingly moved on the top surface 74*a*, and dropped in the groove member 81 of the distribution structure 8A through the opening 74*b* of the top plate 74. Each of the balls BL enters one of the through-holes 831, 832, 833 from the inside of the groove member 81, and is then dropped in a corresponding one of baskets BS1, BS2, BS3. That is, the balls BL are distributed to the baskets BS1, BS2, BS3 through the distribution structure 8A, and stored in the baskets BS1, BS2, BS3.

Since the top surface 74*a* is inclined with respect to the horizontal plane H by the angle θ2, as mentioned above, the balls BL discharged from the tank 45 of the picker 2 are rollingly moved along the inclination in the negative X-direction. Thus, as shown in FIG. 7, even when each ball BL is dropped on any of points P1, P2, P3 at respective different distances from the distribution structure 8A, the ball BL is directed toward the distribution structure 8A, as indicated by the arrowed lines A71, A72, A73.

When the discharge of the balls BL is completed, the picker 2 is controlled to move forwardly in the positive X-direction, and descends the ascending-descending sloping surface 75*a* of the pit 5A to move from the top surface 74*a* to the floor F. The picker 2 arrived at the floor F further moves on the floor F to pick up other balls BL. A worker of the driving range moves the basket BS in the Y-direction as indicated by the arrowed line A74 in FIG. 7 to take out balls BL from the ball-collecting space 51A through the open zone 52A, while leaving the balls BL in the basket BS.

Functions/Effects

Next, functions/effects based on the system 1A according to the second embodiment will be described.

In the second embodiment, the top surface 74*a* is inclined with respect to the horizontal plane H and is formed to cause the balls BL discharged from the picker 2 to be rollingly moved along the inclination and directed toward the distribution structure 8A.

According to the system 1 configured as above, even if the picker 2 does not strictly set a position at which the balls BL are discharged, the inclination of the top surface 74*a* can give directionality to the discharged balls BL, thereby guiding the balls BL to the distribution structure 8A.

The above embodiments and modifications have been shown only for facilitating understanding of the present invention, but are not intended to restrict a technical scope of the present invention. Each element and the arrangement, material, conditions, shape, size, etc., thereof in the above embodiments are not limited to those exemplified therein, but may be appropriately modified.

For example, in the above system 1, respective angles of the ascending sloping surface 72*a* and the descending sloping surface 73*a* with respect to the horizontal plane H are approximately the same. However, the present invention is not limited to this configuration. The angles may be different from each other, depending on a location to which the system 1 is applied, so as to allow the picker 2 to easily ascend or descend a slope.

In the above systems 1 and 1A, the balls BL are distributed to the baskets BS through the distribution structure 8 or 8A. However, the present invention is not limited to this configuration. For example, in the system 1, the balls BL may be dropped in the baskets BS in the ball-collecting space 51 through the opening 71*b* of the top plate 71 without using the distribution structure 8. On the other hand, in the system 1A, the balls BL may be dropped in the baskets BS in the ball-collecting space 51A, through the opening 74*b* of the top plate 74, or from the negative X-directional end of the top plate 74*a*, without using the distribution structure 8A.

LIST OF REFERENCE SIGNS

1, 1A: ball collecting system
2: picker
45*a*: bottom surface (picker inclined surface)
5A: pit
51, 51A: ball-collecting space
52, 52A: open zone
6, 6A: support
61: pillar member
71, 74: top plate (plate-shaped member)
71*a*, 74*a*: top surface
72*a*: ascending sloping surface
73*a*: descending sloping surface
75*a*: ascending-descending sloping surface (ascending sloping surface, descending sloping surface)
8, 8A: distribution structure
BL: ball
BS: basket
F: floor

What is claimed is:

1. A ball collecting system for collecting balls on a floor, comprising:

a picker configured to pick up the balls while moving on the floor; and a pit having a ball-collecting space, a top surface located above the ball-collecting space, and an ascending sloping surface on which the picker ascends so as to move from the floor to the top surface, the pit being configured to enable the balls discharged from the picker on the top surface to be collected in the ball-collecting space, wherein a plurality of baskets whose upper parts are open are disposed in the ball-collecting space to allow the discharged balls to be dropped and stored in the plurality of baskets, wherein the ball-collecting space is configured such that one end thereof in a horizontal direction is formed as an open zone, to allow the plurality of baskets to be taken out from the ball-collecting space through the open zone, and wherein the pit comprises a distribution structure, the distribution structure comprising a plurality of pipe members for distributing the balls discharged from the picker to the plurality of baskets disposed in the ball-collecting space.

2. The ball collecting system as recited in claim 1, wherein the pit has a descending sloping surface on which the picker descends so as to move from the top surface to the floor, and wherein the ascending sloping surface, the top surface and the descending sloping surface are arranged along a first direction in top plan view, and the open zone is formed at one end of the ball-collecting space in a second direction intersecting the first direction, in top plan view.

3. The ball collecting system as recited in claim 1, wherein the pit comprises:

a plate-shaped member defining the top surface; and a support supporting the plate-shaped member from therebelow, the support comprising a plurality of pillar members each extending in a vertical direction, wherein the ball-collecting space and the open zone are formed among the plurality of pillar members.

4. The ball collecting system as recited in claim 1, wherein at least one of the top surface and the distribution structure is provided with an inclined surface which is inclined with respect to a horizontal plane to cause the balls discharged from the picker to be rollingly moved.

5. The ball collecting system as recited in claim 1, wherein the top surface is configured to cover at least part of the ball-collecting space in top plan view.

6. The ball collecting system as recited in claim 1, wherein the picker has a picker inclined surface configured to cause the balls to be rollingly moved and directed toward the ball-collecting space.

* * * * *